United States Patent [19]

Hentschel

[11] Patent Number: 4,785,559

[45] Date of Patent: Nov. 22, 1988

[54] EXCAVATOR FOR MAKING A SUBSTANTIALLY VERTICAL SLOT IN THE GROUND

[75] Inventor: Volker Hentschel, Dorsten, Fed. Rep. of Germany

[73] Assignee: Hochtief Aktiengesellschaft Vorm. Gebr. Helfmann, Essen, Fed. Rep. of Germany

[21] Appl. No.: 32,334

[22] Filed: Mar. 30, 1987

[30] Foreign Application Priority Data

Apr. 10, 1986 [DE] Fed. Rep. of Germany ..... 3612020

[51] Int. Cl.[4] ..... E02F 5/08; E02F 3/24

[52] U.S. Cl. ..... 37/94; 37/189; 172/123; 172/125; 299/40; 299/74

[58] Field of Search ..... 37/80 A, 91, 94; 172/60, 118, 122, 123, 125; 299/39, 40, 73, 74; 137/189

[56] References Cited

U.S. PATENT DOCUMENTS

| | | | |
|---|---|---|---|
| 3,933,053 | 1/1976 | Bartels | 37/94 |
| 4,030,217 | 6/1977 | Satterwhite | 299/73 |
| 4,662,684 | 5/1987 | Marten | 299/39 |

FOREIGN PATENT DOCUMENTS

| | | | |
|---|---|---|---|
| 524667 | 5/1956 | Canada | 37/94 |
| 3424999 | 6/1956 | Fed. Rep. of Germany . | |
| 3602387 | 6/1987 | Fed. Rep. of Germany . | |

*Primary Examiner*—David A. Wiecking
*Assistant Examiner*—James R. McDaniel
*Attorney, Agent, or Firm*—Herbert Dubno

[57] ABSTRACT

The apparatus for making a substantially vertical slot in the ground in a step in making a sealing or supporting wall comprises a frame member, a supporting shield, at least two cutting wheels and a drive unit. The supporting shield is attached to the frame member and supports the cutting wheels and the drive unit. The cutting wheels are mounted on a common shaft and at least a portion of the drive unit is enclosed by at least one of the cutting wheels. A housing projecting pipe like on both of its opposing sides is attached to the supporting shield. Each of the cutting wheels have a hub which is mounted on a common shaft mounted in the housing. A hollow drive wheel is provided for the cutting wheels and is mounted advantageously on a stepped in seat on one of the hubs. It fits in the housing with play. The hollow drive wheel meshes with a plurality of drive gears each connected to a drive motor. The drive motors are distributed around the circumference of the hollow drive wheel supported on a drive motor support inserted in the housing.

1 Claim, 2 Drawing Sheets

EXCAVATOR FOR MAKING A SUBSTANTIALLY VERTICAL SLOT IN THE GROUND

FIELD OF THE INVENTION

My present invention relates to an apparatus for excavating a substantially vertical slot in the ground and, more particularly, to an apparatus for producing a substantially vertical slot in the ground to enable the formation of a sealing or supporting wall.

BACKGROUND OF THE INVENTION

An apparatus for excavating a substantially vertical slot in the ground as a step in making a sealing wall or a supporting wall generally comprises a frame member, a supporting shield, at least two cutting wheels and a drive unit.

The supporting shield is attached to the frame member and carries the cutting wheels and the drive unit. Further the cutting wheels are mounted on a common shaft and a portion of the drive unit is enclosed by a cutting wheel. The supporting shield can be connected pivotally to the frame member (German Open Patent Application DE-OS No. 36 02 387).

The drive motors are placed above the supporting shield in the frame member in the apparatus according to German Open Patent Application DE-OS No. 34 24 999. Transmission elements extend from this drive motor through holes and recesses in the supporting shield to the region of the axis of the cutting wheels.

Other gear elements or drive elements also are located in openings and recesses in the supporting shield. The holes or recesses are made larger for cutting wheels with larger drive torques. This reduces the polar moment of inertia of the supporting shield. However, to enable the increased load to be borne, the supporting shield must be stout. That is disadvantageous since a comparatively thick supporting shield with wide flank spacing and hence large interwheel spacing between the cutting wheels is required; this means that a broad web of earth remains between the wheels when they operate, thereby causing problems.

OBJECTS OF THE INVENTION

It is an object of my invention to provide an improved apparatus for excavating a substantially vertical slot in the ground, particularly in a step in making a sealing or supporting wall, which will eliminate the aforementioned drawbacks.

It is also an object of my invention to provide an improved apparatus for making a substantially vertical slot in the ground which can be operated with a comparatively thin supporting shield and with a reduced spacing between the cutting wheels which nevertheless can sustain a comparatively large operating torque.

SUMMARY OF THE INVENTION

These objects and others which will become more readily apparent hereinafter are attained in accordance with my invention in an apparatus for making a substantially vertical slot in the ground in a step in making a sealing or supporting wall comprising a frame member, a supporting shield, at least two cutting wheels and a drive unit. The supporting shield is attached to the frame member and supports the cutting wheels and the drive unit. Further the cutting wheels are mounted on a common shaft and at least a portion of the drive unit is enclosed by one of the cutting wheels.

According to my invention a cylindrical housing projects laterally on both of the opposing sides of the supporting shield to form hollow shafts. Each of the cutting wheels has a hub which extends into and is mounted on a common shaft mounted in the housing and the latter are received in the respective cutting wheels.

A hollow drive wheel for the cutting wheels is mounted on one of the hubs and fits into the respective housing or hollow shaft with play.

This hollow drive wheel meshes with a plurality of drive gears each connected to a respective drive motor. These drive motors are distributed around the circumference of the hollow drive wheel.

The drive motors are mounted on a drive motor support received in the housing.

In a simple construction contemplated by the invention and with high reliability, the cutting wheels are supported with their hubs in the housing by conical roller bearings (combined thrust/radial bearings).

The hollow drive wheel is advantageously mounted on the associated hub by a nested stepped-seat arrangement enabling the drive wheel to be clamped or wedged onto the hub and keyed thereto.

The number of drive motors distributed about the circumference of the hollow drive wheel can be chosen to suit the circumstances. To attain very uniform load bearing properties at least three drive motors are generally provided.

Preferably, however, for very large operating torques, five hydraulic motors used as drive motors are distributed around the circumference of the hollow drive wheel. The cutting wheels can be mounted on the common shaft generally with a gear teeth or spline system. They thus can be removed easily for maintenance and repair or replacement.

The advantages attained by my invention are thus that my apparatus can be operated with a very thin supporting field and consequently with a reduced spacing between the cutting wheels.

Only a small web of ground then remains between the cutting wheels which can be easily washed or broken away.

The housing in my apparatus acts simultaneously as a very reliable case for the drive unit. It is understood that suitable seals are located between the rotating and the nonrotating parts of the apparatus. Gaps between the rotating and nonrotating parts can be flushed without difficulty and thus kept free from contaminants.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
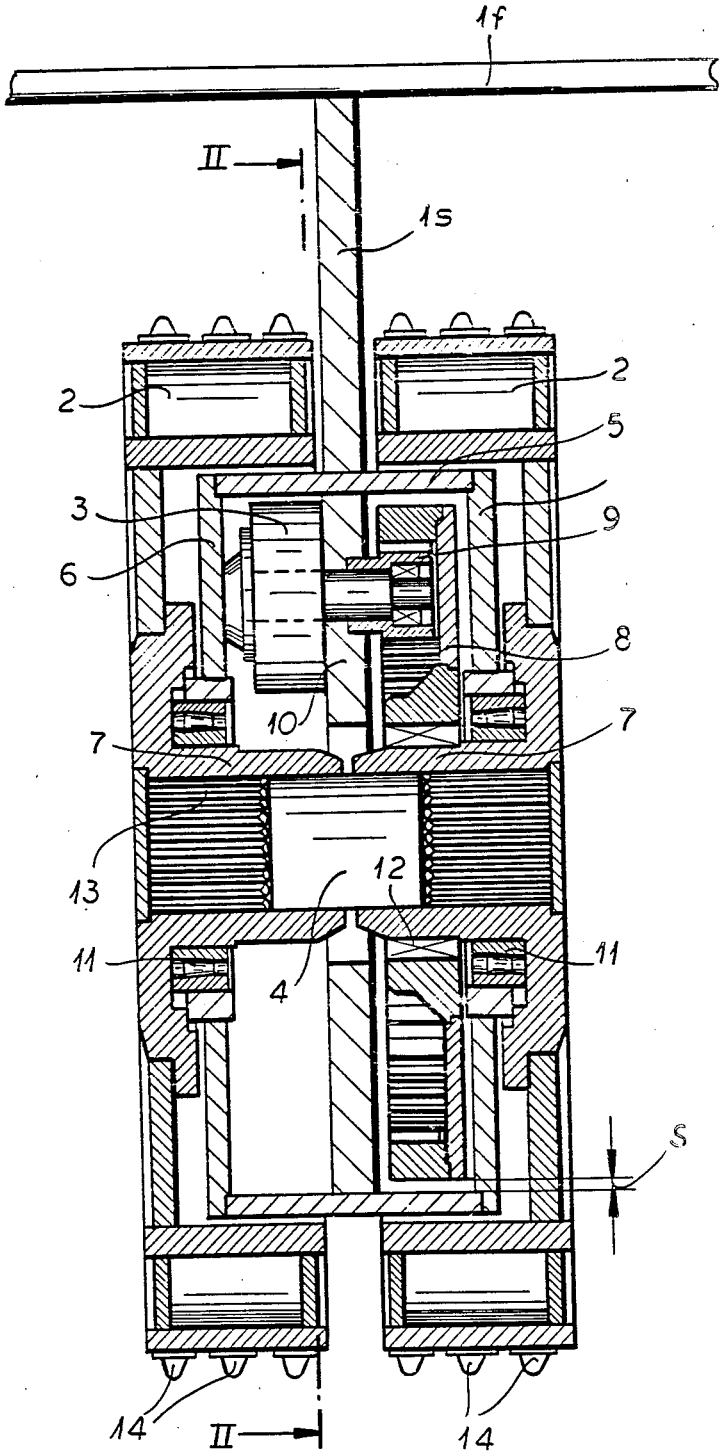
FIG. 1 is a vertical cross sectional view through an apparatus for making a substantially vertical slot in the ground according to my invention.
Figure 2:
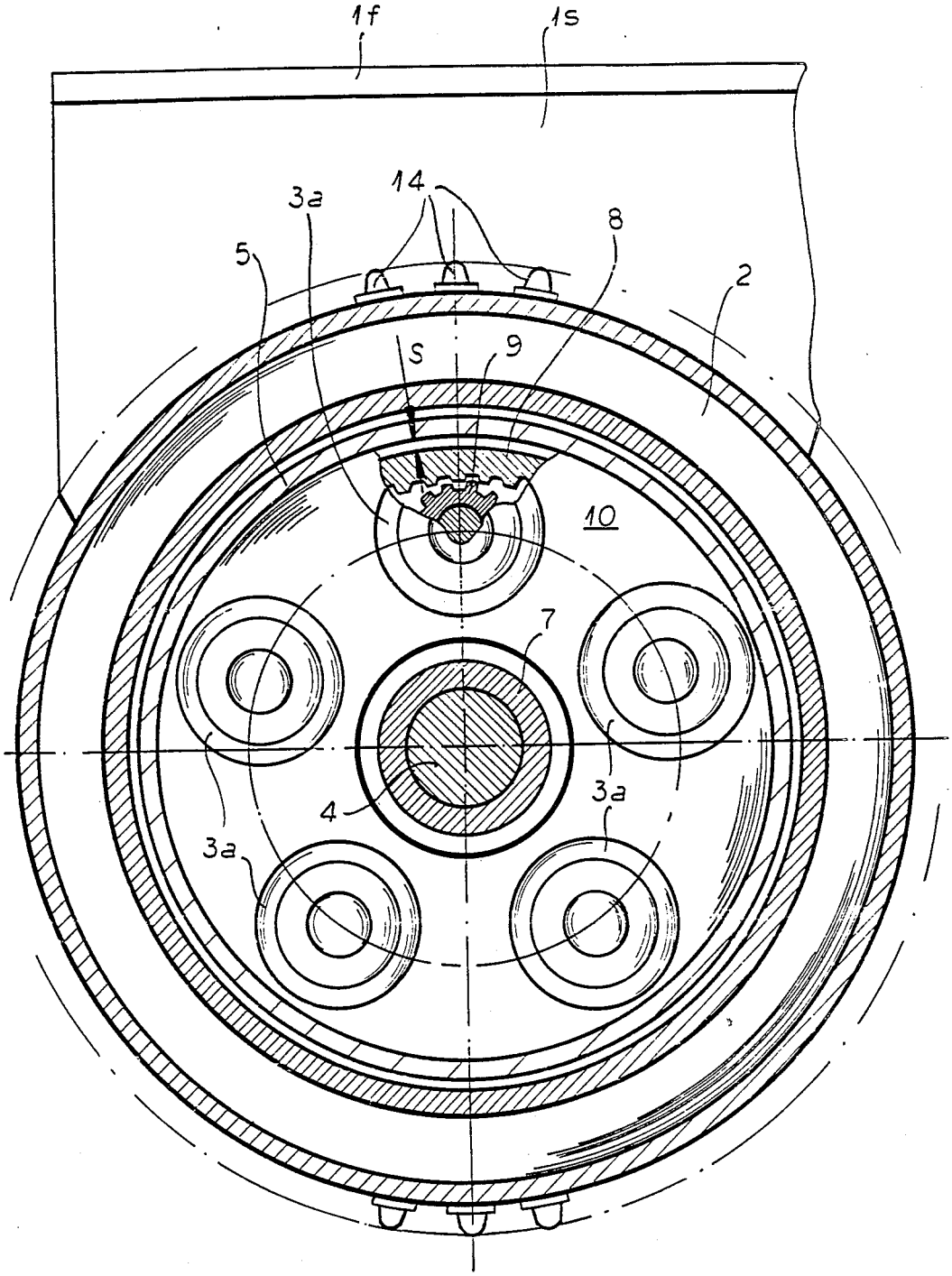
FIG. 2 is a partially broken away transverse cross sectional view taken along the line II—II of FIG. 1.

The apparatus shown in cross section in the drawing acts to excavate a substantially vertical slot in the ground in a step in making a sealing or supporting wall and as part of an excavating machine.

The nonrotating parts are drawn with thicker border lines than the rotating parts illustrated by hatching lines which are closer together.

The apparatus basically comprises a frame member 1*f*, a supporting shield 1*s*, two cutting wheels 2 and a drive unit 3.

The frame member 1*f* has been only shown in part in the drawing.

The supporting shield 1*s* can be pivotally, attached to the frame member 1*f*. The shield is supports the cutting wheels 2 and the drive unit 3. The cutting wheels 2 are connected by a common shaft 4. Portions of the drive unit 3 are enclosed by the cutting wheels 2.

A cylindrical housing 5 projecting like a hollow shaft on each of its opposing sides from a vertical plane of the field is attached to the supporting shield 1*s*.

The housing 5 is largely closed off from the cutting wheels 2 by covers 6 on the ends of the housing 5.

Both cutting wheels 2 have inwardly extending hubs 7 on the common shaft 4 and supported in the housing 5 and specifically on the covers 6.

A hollow drive wheel 8 for the cutting wheels 2 is mounted on one of the hubs 7 shown on the right in FIG. 1. It is received in the housing 5 with peripheral or radial clearance S.

The hollow drive wheel 8 meshes with a plurality of drive gears 9 each being driven by a respective drive motor 3*a*. These drive motors 3*a* of the drive unit 3 are distributed in angularly equispaced relationship around the circumference of the hollow drive wheel 8. They are supported on a drive motor support 10 fixed in the housing 5.

The cutting wheels 2 are supported with their hubs 7 in the housing 5 by conical roller bearings 11. The hollow drive wheel 8 is mounted on the associated hub 7 in a stepped in seat 12. In this example five drive motors 3*a* are placed around the circumference of the hollow drive wheel 8. These drive motors 3*a* are hydraulic motors. The cutting wheels 2 are mounted with their hubs on the common shaft 4 with an intervening gear tooth system 13. The cutting wheels 2 are provided with cutting teeth 14 on their outer circumference.

In operation, hydraulic fluid is pumped by a pump of a vehicle formed with the frame 1*f* but not otherwise shown in the drawing and usually driven by a prime mover, such as an international combustion engine, (not shown) via hydraulic lines (not shown) to all of the hydraulic motors 3*a* in parallel.

The hydraulic motors are, of course, fixed to the cylindrical housing 5 and its wall 10 as supported by the shield 1*s*. These motors all simultaneously power the hollow drive wheel 8.

The hollow drive wheel is coupled with a hub 7 by the nested clamping arrangement shown diagrammatically at 12 so that the right hand wheel (FIG. 1) is driven directly and because this hub 7 is splined to the shaft 4 and the hub 7 of the other wheel 2 is likewise splined to the shaft 4, both wheels are rotated simultaneously to cut away the earth in a width equal to the overall horizontal width of the assembly as seen in FIG. 1. With the invention, any spacing between the cutting wheels 2 is small and barely of a thickness greater than that of the shield, so that the web of earth which remains to be washed away or broken away is comparatively thin.

I claim:

1. A cutter assembly for an excavator for excavating a substantially vertical slot in the ground, said cutter assembly comprising:

a frame;

a substantially vertical planar support shield extending downwardly from said frame and consisting of a solid plate;

a tubular housing fixed on said support shield and having an axis extending generally perpendicular to said support shield with respective tubular portions lying to opposite sides of a plane of said support shield;

a respective cutting wheel surrounding each of said tubular portions so that said cutting wheels axially overlap said tubular portions and lie close to opposite sides of said shield, the thickness of said plate determining the axial spacing of said cutting wheels;

respective annular covers on opposite axial ends of said housing for closing same;

a respective hub on each of said cutting wheels extending axially into said housing through the respective cover;

a common shaft engaged in both of said hubs for angularly coupling said hubs for joint rotation;

respective bearing means journaling each hub in and on the respective cover;

an internally toothed hollow wheel keyed to one of said hubs in said housing;

a motor-support plate fixed in said housing between said portions in the plane of the support shield, said shaft passing with clearance through a hole in said motor-support plate;

a plurality of drive motors mounted on said support plate, spaced around said axis and having respective drive gears meshing with said hollow wheel for driving same and thereby driving said cutting wheels, said bearing means including a conical bearing journaling each hub in the respective core, said shaft having splines on opposite ends and said hubs having splines interfitting with the splines of said ends of said shaft, said motors being hydraulic motors mounted on said motor-support plate and having shafts extending through and journaled in said motor-support plate and carrying said drive gears for meshing with said internally toothed hollow wheel on a side of said motor-support plate opposite that on which said motors are mounted.

* * * * *